US005377641A

United States Patent [19]

Salazar

[11] Patent Number: 5,377,641

[45] Date of Patent: Jan. 3, 1995

[54] TIMER-CONTROLLED START/STOP DEVICE FOR AN AUTOMOBILE

[76] Inventor: Gerardo S. Salazar, 452 Circle Dr., Rantoul, Ill. 61866

[21] Appl. No.: 64,394

[22] Filed: May 19, 1993

[51] Int. Cl.[6] ..... F02N 11/08

[52] U.S. Cl. ..... 123/179.4; 180/286; 307/10.6; 477/99

[58] Field of Search ..... 123/179.4, 179.3, 179.23, 123/179.2; 290/38 C, 38 R; 74/850; 307/10.6; 180/286; 477/99

[56] References Cited

U.S. PATENT DOCUMENTS

| | | | |
|---|---|---|---|
| 3,220,397 | 11/1965 | Fenner | 123/179.3 |
| 3,259,753 | 7/1966 | McWhirter | 123/179.3 |
| 3,443,557 | 5/1969 | Hebert | 123/179.3 |
| 3,685,606 | 8/1972 | Blow, Jr. | 290/38 C |
| 4,188,931 | 2/1980 | Waterhouse | 123/179.3 |
| 4,296,334 | 10/1981 | Wong | 290/38 C |
| 4,331,880 | 5/1982 | Dittman et al. | 123/179.3 |

*Primary Examiner*—Andrew M. Dolinar

[57] ABSTRACT

An automatic start/stop apparatus for an automobile including a timer (22) adapted to activate or deactivate a circuit designed to turn on the accessory circuit (42), the ON circuit (44) and the start circuit (50) of an automobile. An oil pressure switch (48) is adapted to stop the starter motor once the engine is running. If the engine failed to start, a solid state timer (46) is adapted to allow cranking of the starter motor only for a preselected amount of time. A hood switch (24) is included to prevent the device from operating when the hood is opened for maintenance. A park switch (26) is also included to stop the device from operating, to prevent unauthorized person to drive away the vehicle.

2 Claims, 1 Drawing Sheet

TIMER-CONTROLLED START/STOP DEVICE FOR AN AUTOMOBILE

BACKGROUND-FIELD OF INVENTION

Figure 1:
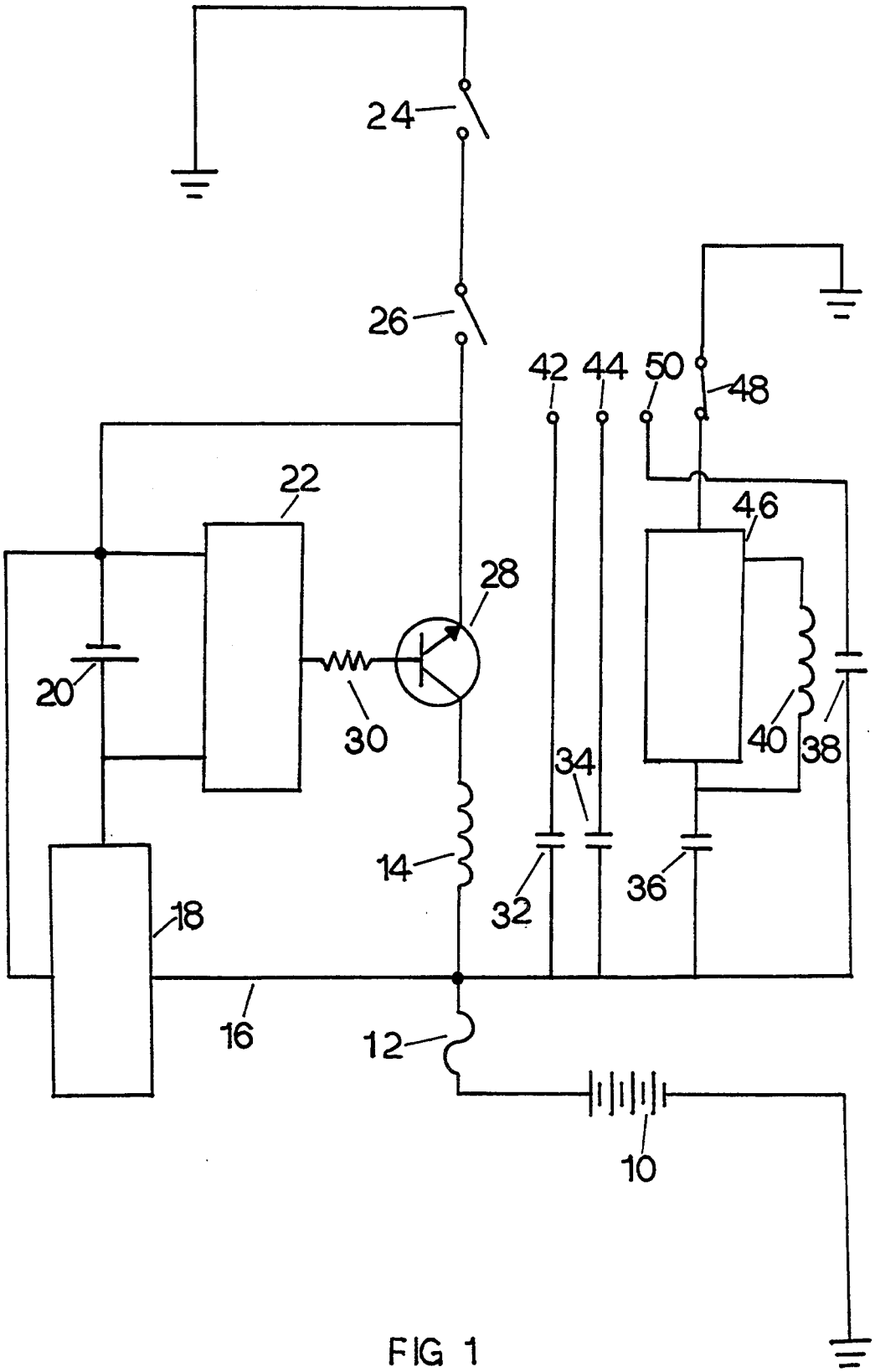

This invention relates to automatic starting devices for automobiles and specifically relates to devices for the starting and stopping of automobile engines which may be fuel injected at preselected times.

BACKGROUND-DESCRIPTION OF PRIOR ART

In geographical areas experiencing cold climates, it has long been practiced to start automobiles or other motor vehicles before driving the vehicle to warm up the vehicle's engine. Also, in areas where snow may fall upon an ungaraged vehicle, it is desirable to start the engine and have the heater and defroster operate so that the snow on the vehicle's window surfaces can melt, and also to warm up the passenger's compartment. Further, in areas experiencing hot climate, it is also desirable to start the engine and have the air conditioner operate to cool down the passenger's compartment prior to driving the vehicle.

There have been many devices developed over the years to remotely and automatically start automobiles for the purposes mentioned above. Some of these devices have been patented. Such as in U.S. Pat. No. 2,991,370 by Sutton. The device of this patent utilizes a timer within this device with a conventional cut-out switch for a generator closed only when motor is running to sense if the generator has started. Thus, if the engine will not start and the timer has been set for about 15 minutes, the engine will crank for 15 minutes, maybe draining the battery. Another device described in U.S. Pat. No. 3,942,024 by Ingham discloses a device having three timers and using the voltage produced by a generator to disconnect a starter from a power source. U.S. Pat. No. 4,928,778 discloses a device for remotely starting the engine. Thus, during early mornings, a person has to be awake and within range to start the engine, which is inconvenient. A more recent patent, U.S. Pat. No. 4,188,931 by Waterhouse discloses an apparatus having a clock timer and a solenoid adapted to activate a throttle linkage.

OBJECTS AND ADVANTAGES

Accordingly, besides the objects and advantages of the devices mentioned above in the prior art, several objects and advantages of the present invention are:

(a) to provide a very simple timer-controlled start/-stop device for an automobile which can start or stop an automobile up to six start/stop settings per week in each days of the week combination;

(b) to prevent unauthorized use of the vehicle by an individual attempting to drive it away from its location once the vehicle has automatically started, without the owner inside the vehicle;

(c) to prevent starting the vehicle while the hood is open, to prevent accident when a person is doing some maintenance on the engine;

(d) to provide a start/stop device for an automobile which can easily be programmed by the user to times and length of time they desire;

(e) to provide a start/stop device for an automobile equipped with a back-up battery to retain timer memory;

(f) to provide a start/stop device for automobiles with a manual on/off switch;

(g) to prevent the car from moving when the parking lever accidentally shifts into gear when the vehicle has automatically started.

Still further objects and advantages will become apparent from a consideration of the ensuing description and drawings.

DRAWING FIGURE

FIG. 1 shows a schematic diagram of the Timer-Controlled Start/Stop Device for an Automobile.

| Reference Numerals in Drawing |
|---|
| 10 12 volt battery |
| 12 fuse |
| 14 relay |
| 16 line |
| 18 voltage regulator |
| 20 1.5 volt back-up battery |
| 22 timer |
| 24 hood switch |
| 26 park switch |
| 28 transistor |
| 30 resistor |
| 32 first set of contacts of relay 14 |
| 34 second set of contacts of relay 14 |
| 36 third set of contacts of relay 14 |
| 38 set of contacts of relay 40 |
| 40 relay |
| 42 accessory terminal |
| 44 ON terminal |
| 46 solid state timer |
| 48 oil pressure switch |
| 50 start terminal |

DESCRIPTION-FIG. 1

FIG. 1 illustrates a schematic view of the device of the invention. Seen in this view is a power source of the vehicle being a 12 volt battery 10. The negative pole of battery 10 is attached by a line to the ground while the positive pole of battery 10 is attached by a line through a fuse 12 to the positive side of a coil of a relay 14. A line 16 runs from the positive side of the coil of relay 14 to the positive input terminal of a voltage regulator 18. The negative side of voltage regulator 18 is attached by a line to the negative side of a back-up battery 20. The positive side of battery 20 is attached by a line to the output terminal of voltage regulator 18. Also the positive side of battery 20 is attached by a line to the positive side of a timer 22, while the negative side of battery 20 is attached by a line to the negative side of timer 22.

One terminal of a hood switch 24 is attached by a line to the ground. The other terminal of switch 24 is attached by a line to one terminal of a park switch 26, the other terminal of switch 26 is attached by a line to the negative side of battery 20 and also attached by a line to the emitter of a transistor 28. The base of transistor 28 is attached by a line through a resistor 30 to the output terminal of timer 22. The collector of transistor 28 is attached by a line to the negative side of the coil of relay 14.

Line 16 runs from the positive side of the coil of relay 14 to one side of a first set of contacts 32, a second set of contacts 34 and a third set of contacts 36 of relay 14 and continues to a set of contacts 38 of a relay 40.

The other side of contacts 32 is attached by a line to an accessory terminal 42. The other side of contacts 34 is attached by a line to an ON terminal 44 and the other side of contacts 36 is attached by a line to the positive side of a solid state timer 46. The negative side of timer 46 is attached by a line to one terminal of an oil pressure switch 48. The positive side of timer 46 is attached by a line to the positive side of the coil of relay 40. The negative side of the coil of relay 40 is attached by a line to the load side of timer 46. The other side of contacts 38 is attached by a line to a start terminal 50.

OPERATION-FIG. 1

Transistor 28 is controlled by the output of timer 22 through a biasing resistor 30. The output of timer 22 actuates the transistor 28 to conduct or not to conduct current at a time that is preset within timer 22. When transistor 28 is conducting, current conducts through the coil of relay 14, closing contacts 32, contacts 34, and contacts 36. Current passes through the closed contacts 32 to the accessory terminal 42. Current also passes through the closed contacts 34 to the ON terminal 44. Also, current passes through the closed contacts 36 to the positive side of timer 46.

With the oil pressure switch 48 closed, current conducts through timer 46, connecting one side of relay 40 to the load side of timer 46. Since the other side of relay 40 is connected to the positive side of timer 46, current flows through relay 40, closing contacts 38. Current passes through the closed contacts 38 to the start terminal 50, which cranks the engine.

If the engine doesn't run, the engine will continue to crank until the predetermined amount time of timer 46 runs out, disconnecting one side of the coil of relay 40 from the load side of timer 46, which opens contacts 38, stopping the flow of current to the start terminal 50.

When the engine runs, oil pressure builds up opening the oil pressure switch 48 which stops the flow of current through timer 46 and relay 40, opening contacts 38 which stops the cranking of the engine at this time. Current still flows to terminal 42 and terminal 44.

When switch 24 or switch 26 is opened or when timer 22 times out, current stops passing through relay 14, opening contacts 32, contacts 34 and contacts 36, stopping the flow of current to terminal 42, terminal 44 and timer 46.

Without the battery 10 being connected, timer 22 can still be programmed because of battery 20. However, it will not be able to conduct enough current through relay 14 to start the operation of the device. Voltage regulator 18 is used to supply timer 22 with its power requirement.

SUMMARY, RAMIFICATIONS, AND SCOPE

Many of the parts of this invention can be located inside the dash board with only the face and push buttons of the device showing flush in front of the dash board. The device is equipped with a back-up battery so that times programmed in the device will not be lost. This is useful when the vehicle's battery goes dead or when it is necessary to remove the battery specially during maintenance. However, the device cannot start the vehicle with the back-up battery alone.

The device can be set to turn on or off with up to six on/off settings per week in each days of the week combination. As an example, a person working can set the device to start his vehicle before going to work, before going to lunch, after going to lunch and after work. When the preselected time arrives, the device will start to crank the engine with the starter motor. When the engine is running, oil pressure builds up opening the oil pressure switch, disengaging the starter motor. At a preselected time, the device will stop the engine automatically. If the engine does not run in about a minute, the device will stop the engine from further cranking to prevent draining the vehicle's battery.

As a safety precaution, the device also includes a hood switch which will stop the device from running the engine when the hood of the vehicle is opened. This is specially helpful during engine maintenance. Another safety precaution is the park switch, which is also included in the device, to stop the device from running the engine to prevent the vehicle from moving if the parking lever shifts into gear. The park switch also prevents unauthorized use of the vehicle by a person trying to drive the vehicle away without the owner.

Although the description above contains many specificities, these should not be construed as limiting the scope of the invention but as merely providing illustrations of the presently preferred embodiment of this invention. For example, the relays can be replaced by transistors.

Thus the scope of the present invention should be determined by the appended claims and their legal equivalents, rather than by the examples given.

I claim:

1. A start/stop device in combination with a vehicle having an internal combustion engine, an ignition system, starter motor, a power source, an oil pressure switch comprising:

(a) a first switch means having one terminal connected to the negative side of said power source adapted to open when a hood of the said vehicle is opened, (b) a second switch means connected in series to said first switch means adapted to open when a shifting lever of said vehicle is placed out of park, (c) a first timer means having an output that can be set to turn on or off at preselected times, (d) a transistor connected to the output of said first timer means, (e) a second timer means that can be set to turn on only a predetermined amount of time when activated, said second timer means is connected in series to said oil pressure switch to deactivate said second timer means when oil pressure builds up when the engine is running to stop the cranking of said engine, (f) a first relay having a first, a second and a third set of contacts and a coil, the coil of said first relay is connected to said transistor, the activation of said first relay applies power to an accessory terminal, an on terminal and said second timer means though the first, the second and the third contacts respectively, (g) a second relay actuated by said second timer means, said second relay having a set of normally open contacts, the closing of said set of normally open contacts applies power to a start terminal, (h) Voltage regulating means for supplying the power requirements of said first timer means and, (i) Back-up power means for supplying power to said first timer means when said power source fails.

2. A start/stop device in accordance with claim 1 wherin said internal combustion engine is fuel injected.

* * * * *